United States Patent [19]

Sussman

[11] 4,165,572

[45] Aug. 28, 1979

[54] DISPLAY STAND

[75] Inventor: Morris Sussman, Freeport, N.Y.

[73] Assignee: Shore Plastics, Inc., Freeport, N.Y.

[21] Appl. No.: 857,601

[22] Filed: Dec. 5, 1977

[51] Int. Cl.[2] ..... G09F 1/12

[52] U.S. Cl. ..... 40/10 D; 40/152.1

[58] Field of Search ..... 40/10 D, 152, 156, 155, 40/152.1

[56] References Cited

U.S. PATENT DOCUMENTS

| | | | |
|---|---|---|---|
| 737,124 | 8/1903 | Manor | 40/10 D X |
| 2,746,190 | 5/1956 | Schenkman | 40/159 X |
| 3,707,053 | 12/1972 | Itano | 40/158 R |
| 3,820,262 | 6/1974 | Dewsnap | 40/10 D |
| 3,956,837 | 5/1976 | Itano | 40/10 D |
| 4,091,555 | 5/1978 | Korzon | 40/155 X |

FOREIGN PATENT DOCUMENTS

| | | | |
|---|---|---|---|
| 899567 | 12/1953 | Fed. Rep. of Germany | 40/156 |

*Primary Examiner*—Louis G. Mancene

*Assistant Examiner*—Wenceslao J. Contreras

*Attorney, Agent, or Firm*—Michael Ebert

[57] ABSTRACT

A display stand for holding an advertisment or other notice in sheet form in an upright position on a counter or desk. The stand is constituted by a pair of complementary pieces each formed by a transparent panel having a right-angle ledge extending from its lower end so that when the two panels are brought together to sandwich a display sheet therebetween, the ledges which extend in opposite directions then define a base to support the panels in an upright position. Each panel, just above the junction of its lower end and ledge, is provided with interlocking elements in the form of a rectangular slot and a companion tongue which projects in a direction opposite to the ledge direction. When the panels are brought together, the tongue of one fits neatly into the slot of the other, each tongue having an edge notch therein making it possible to slide one panel relative to the other to a position at which the panels are then coincident with each other and are interlocked.

5 Claims, 6 Drawing Figures

Fig. 1.
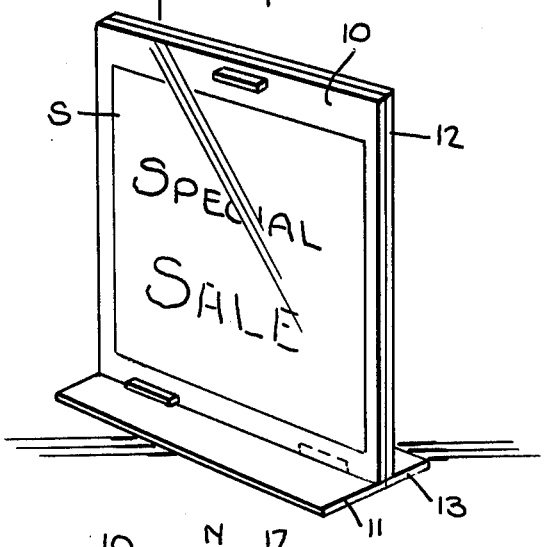
Fig. 3.
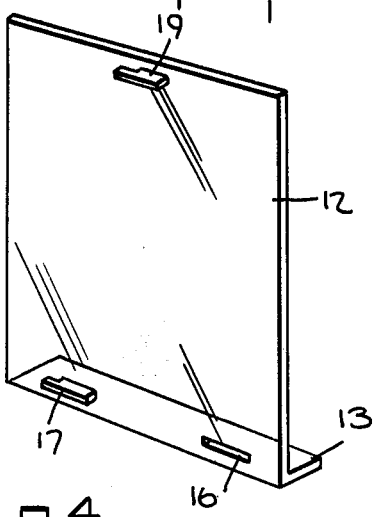
Fig. 4.
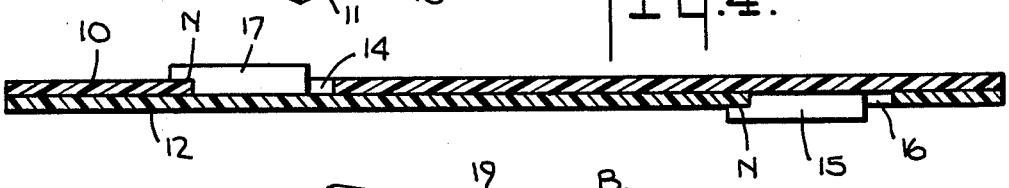
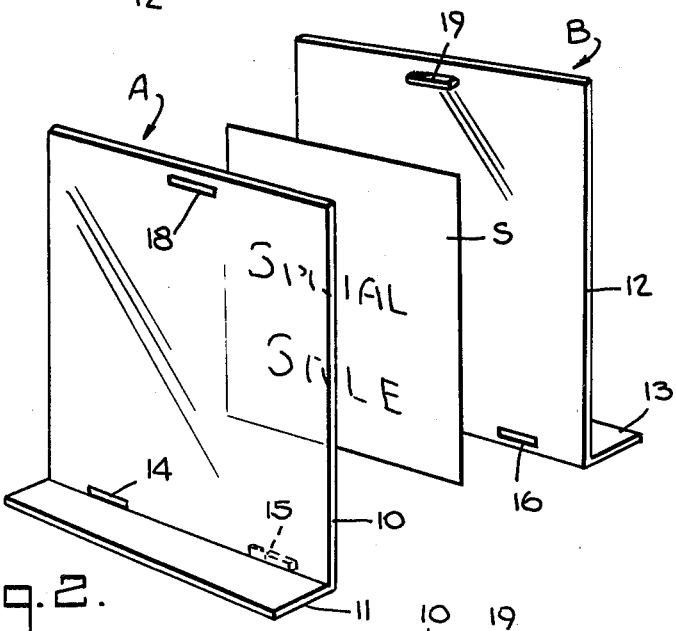
Fig. 2.
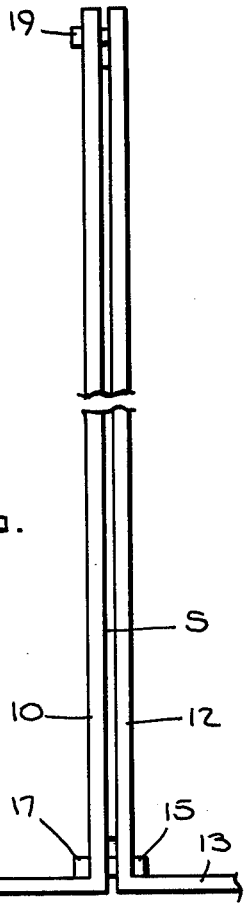
Fig. 5.
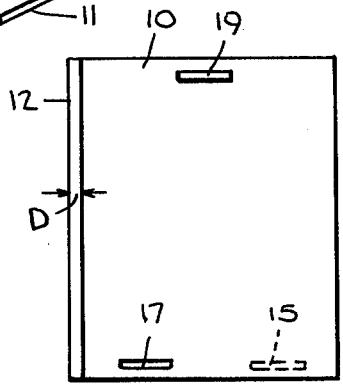
Fig. 6.

DISPLAY STAND

BACKGROUND OF INVENTION

This invention relates generally to display stands for holding an advertisement or other notice in sheet form in an upright position on a counter or desk, and more particularly to a stand in which the sheet is protectively sandwiched and securely held between complementary transparent panels that are interlocked.

There are many situations which call for a display stand or easel for presenting an advertisement, an announcement or some other notice in sheet form intended for public viewing. Thus on the counters or desks of airline ticket offices, banks, retail stores and other facilities that deal with the public, it is often necessary to present a notice that is clearly visible to all persons approaching the counter or desk.

Easels heretofore provided for this purpose have several disadvantages. The typical easel takes the form of a tripod-like frame adapted to support a card or sheet at an angle. Because the easel has spread-apart legs or other supports, the amount of space it requires represents an inconvenience in a heavily-used counter or desk. Also, with a typical easel, the sheet or notice card merely rests on the frame and is easily dislodged or removed therefrom. And because the surface of the sheet or card is exposed and unprotected, it is subject to being soiled and mutilated.

SUMMARY OF INVENTION

In view of the foregoing, the main object of the present invention is to provide a stable display stand supporting a card or sheet in an upright position, the stand having minimal space requirements.

More particularly, it is an object of this invention to provide a display stand constituted by a pair of complementary pieces each having a transparent panel, the sheet to be displayed being sandwiched between the panels and being protected thereby.

Also an object of the invention is to provide a display stand of the above-noted type whose pieces include complementary interlocking elements whereby the sheet sandwiched therebetween is held securely in place.

Yet another object of this invention is to provide a low-cost two-piece display stand which may be quickly assembled or disassembled.

Briefly stated, these objects are attained in a display stand in accordance with the invention which is constituted by a pair of complementary pieces, each formed by a transparent panel having a right-angle ledge extending from the lower end thereof so that when the two panels are brought together to sandwich a display sheet therebetween the ledges which extend in opposite directions then define a base to support the stand in an upright position.

Each panel, just above the junction of its lower end and ledge, is provided with interlocking elements in the form of a rectangular slot and a companion tongue of the same length and width which projects in the direction opposite to the ledge direction. When the complementary panels are brought together, the tongue of one fits neatly into the slot of the other. Each tongue is provided with an edge notch making it possible to slide one panel relative to the other to a position at which the two panels are then coincident with each other and are interlocked.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a two-piece display stand in accordance with the invention in the assembled state in which a display sheet is held therein;

FIG. 2 is a perspective view of the stand in the disassembled state;

FIG. 3 is a perspective view of one of the two pieces;

FIG. 4 is a plan view of one of the interlock tongues;

FIG. 5 is an end view of the display stand in the assembled state; and

FIG. 6 is a front view of the complementary panels prior to their interlock.

DESCRIPTION OF INVENTION

Referring now to the drawing, there is shown a display stand in accordance with the invention, the stand being constituted by a pair of complementary pieces A and B. Piece A is formed of a transparent panel 10 having a right-angle ledge 11 extending from the lower end thereof. Piece B is formed by a matching transparent panel 12 having a right-angle ledge 13 extending from the lower end thereof.

The display stand is designed to support a sheet S in an upright position, sheet S being an announcement, an advertisement or any other form of notice to be displayed. The dimensions of sheet S are somewhat smaller than those of panels 10 and 12 so that no portion thereof protrudes from the stand when sheet S is sandwiched between the panels. The pieces are fabricated of rigid, synthetic plastic material which may be acrylic, PVC or any other suitable plastic of acceptable strength and clarity.

When, as shown in FIG. 1, the panels are brought together to sandwich sheet S therebetween, ledges 11 and 13 which extend in opposite directions then define a base to support the stand in an upright position.

Panel 10, just above the junction of its lower end and ledge, is provided with interlocking elements in the form of a rectangular slot 14 and a companion tongue 15 of the same length and width which projects in the direction opposed to the ledge direction. Panel 12 is likewise provided with a slot 16 and a companion tongue 17. Panel 10 is further provided with an auxiliary slot 18 in a center position above sheet S, which slot cooperates with a correspondingly-positioned auxiliary tongue 19 on panel 12.

When the panels are brought together, the companion tongues of the interlocking elements are neatly received in the slots. The positions of the interlocking elements are such that, as shown in FIG. 6, when the panels 10 and 12 are brought together with the tongues projecting through the slots, the panels are slightly displaced with respect to each other by a distance D. All tongues, as shown in connection with tongues 17 and 18 in FIG. 4, are provided with an edge notch N, making it possible to shift one panel relative to the other by the small distance D to a position at which the two panels are then exactly coincident with each other and are fully interlocked.

Thus to assemble the stand, the sheet S is placed between panels 10 and 12 and the panels are brought together to cause the tongues of the interlocking elements to project through the related slots, the sheet then being sandwiched between the panels which are now slightly displaced from each other. Then one simply shifts one panel relative to the other to bring them into coincidence to interlock the two pieces.

To disassemble the stand and to remove the sheet, one merely reverses the procedure, one panel being shifted slightly relative to the other to release the interlocking elements.

While there has been shown and described a preferred embodiment of a display stand in accordance with the invention, it will be appreciated that many changes and modifications may be made therein without, however, departing from the essential spirit thereof.

I claim:

1. A display stand for a notice sheet comprising a pair of complementary pieces each formed by a transparent panel having a right-angle ledge extending from the lower end thereof, so that when the two panels are brought together to sandwich said sheet therebetween, the ledges extend in opposite directions to define a base to support the stand in an upright position, and interlocking elements just above the junction of the lower end of each panel and its ledge, said elements being in the form of a rectangular slot and a companion tongue of the same length and width, the tongue on each panel projecting in the direction opposed to the ledge direction whereby when the panels are brought together, the tongue of one fits into the slot of the other, each tongue having an edge slot making it possible to slide one panel relative to the other to interlock the panels.

2. A display stand as set forth in claim 1 in which each piece is formed of clear synthetic plastic material.

3. A display stand as set forth in claim 1 in which the positions of the interlocking elements are such that when the panels are brought together, they are slightly displaced relative to each other, the depth of the notches being such that when the panels are interlocked, they are then coincident with each other.

4. A display stand as set forth in claim 1, further including auxiliary interlocking elements in the form of a tongue on one panel adjacent the upper end thereof and a complementary slot in the other panel.

5. A display stand as set forth in claim 4, wherein said sheet has dimensions slightly smaller than the dimensions of said panels and is received in the area within the interlocking elements.

* * * * *